US007427116B2

(12) United States Patent
Nakamura et al.

(10) Patent No.: US 7,427,116 B2
(45) Date of Patent: Sep. 23, 2008

(54) GAP ADJUSTING DEVICE, RECORDING APPARATUS AND LIQUID EJECTION APPARATUS

(75) Inventors: Kazuhisa Nakamura, Nagano-ken (JP); Kazuhiro Hashii, Nagano-ken (JP); Tomoyuki Mokuo, Nagano-ken (JP); Kazuhiko Yamaguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 330 days.

(21) Appl. No.: 11/095,084

(22) Filed: Mar. 30, 2005

(65) Prior Publication Data

US 2005/0253880 A1 Nov. 17, 2005

(30) Foreign Application Priority Data

Mar. 30, 2004 (JP) ..... P2004-100381
Mar. 30, 2004 (JP) ..... P2004-100426

(51) Int. Cl.
*B41J 25/308* (2006.01)

(52) U.S. Cl. ..... 347/8; 347/5; 347/22

(58) Field of Classification Search ..... 347/8, 347/5, 19; 480/56, 605
See application file for complete search history.

(56) References Cited

U.S. PATENT DOCUMENTS 4,927,277 A * 5/1990 Niikawa ..... 400/56
5,479,194 A * 12/1995 Hirano et al. ..... 347/22

FOREIGN PATENT DOCUMENTS

JP 2002-067428 3/2002

* cited by examiner

*Primary Examiner*—Lam S Nguyen
(74) *Attorney, Agent, or Firm*—Edwards Angell Palmer & Dodge LLP; John J. Penny, Jr.

(57) ABSTRACT

It is provided with a pair of carriage guide shafts, and the carriage guide shaft is made to be in sliding contact with a carriage, to realize such a concentric shaft configuration that a guide shaft part, which directly guides a reciprocating motion of the carriage, and rotation shaft parts, which are disposed on both ends thereof, were disposed so as to coincide therewith. In addition, by disposing parallel lifting device which utilized a cam mechanism and a lifting guide portion to side frames, the carriage guide shaft is configured so as to be able to obtain a predetermined lifting stroke which corresponds to a rotation angle. In addition, as synchronous drive transmission mechanism of the pair of carriage guide shafts, a gear wheel train was used.

7 Claims, 10 Drawing Sheets

GAP ADJUSTING DEVICE, RECORDING APPARATUS AND LIQUID EJECTION APPARATUS

BACKGROUND OF THE INVENTION

1. Field of the Invention

This invention relates to a gap adjusting device which is disposed in a recording apparatus being provided with a recording head which performs recording on a recording medium, a platen which is disposed in opposition to the recording head and defines a gap between a head surface of the recording head and the recording medium, a carriage on which the recording head is mounted and which reciprocates in a main scanning direction, and a pair of carriage guide shafts which guide a reciprocating motion of the carriage, and a recording apparatus which was provided with the adjusting device.

Further, the invention relates to a liquid ejection apparatus such as an ink jet recording apparatus, which discharges (ejects) liquid such as ink from its head and performs recording on a recording medium (a medium to which liquid is ejected), and a gap adjusting device which is disposed in the liquid ejection apparatus.

Here, the liquid ejection apparatus is used as a meaning which is not apply only to a recording apparatus such as a printer, a copying machine and a facsimile, which uses an ink jet recording head and which discharges ink from the recording head to perform recording on a recording medium, but also to an apparatus which ejects liquid instead of ink, which corresponds to its application, to a medium to which liquid is ejected, which corresponds to the recording medium, from a liquid ejection head which corresponds to the recording head, to have the liquid attached to the medium to which liquid is ejected.

As liquid ejection heads other than the recording head, it is possible to mention a color material ejecting head which is used in manufacturing color filters such as liquid displays, an electrode material (electric conductive paint) ejecting head which is used in forming electrodes of an organic EL display and a surface light ejecting display (FED) etc., a living organic material ejecting head which is used in manufacturing bio-chips, a sample ejecting head as a precision pipet, and so on.

2. Description of the Related Art

Hereinafter, as one example of the ink jet recording apparatus or the liquid ejection apparatus, an ink jet printer is picked up and will be described. There exists an ink jet printer of such a configuration that a carriage, on which a recording head is mounted, is supported by a pair of carriage guide shafts which were disposed on a front surface side and a rear surface side of the carriage. In the ink jet printer of such the configuration, disposed is a paper gap adjusting device, which can automatically adjust a paper gap in accordance with a thickness of a recording medium, in order to correspond to papers with various thicknesses and a CD-R tray etc.

The paper gap defines a distance between a head surface of a recording head and a paper, and becomes an extremely important factor in performing recording of high precision. As a paper gap adjusting device, adopted is such a configuration that a height of a head surface of a recording head, which is mounted on a carriage, becomes variable by lifting and lowering the carriage by a predetermined stroke, to a platen which is disposed in a fixed state. Then, in order to lift and lower a pair of carriage guide shafts at identical timing, with an identical stroke, in synchronization, a paper gap adjusting device, which is of the following configuration, is adopted.

Firstly, there exists a paper gap adjusting device which was configured such that a driving force is supplied from a drive motor for paper feed, and motive power is transmitted through a rack and pinion mechanism and a link mechanism to a pair of carriage guide shafts. However, in a paper gap adjusting device with such the configuration, it becomes such a complex configuration that a rotary motion of the drive motor is converted into a linear motion, and further, converted again into a rotary motion through the link mechanism, and therefore, the number of components becomes large, and the apparatus grew in size. Particularly, in the rack and pinion mechanism and the link mechanism, an operation area of a linear motion portion becomes large-by any mechanisms, and therefore, it makes it difficult to design a layout for securing the operation area.

Secondly, as shown in Japanese Patent Publication No. JP-A-2002-67428, there exists a paper gap adjusting device, which was configured such that a carriage guide shaft is made as an eccentric shaft configuration, and thereby, it moves up and down along with rotation of the carriage guide shaft. However, in a paper gap adjusting device with such the configuration, in order to enlarge a changing amount of the paper gap, there is such a necessity that an eccentricity amount of the carriage guide shaft is enlarged (which leads up to increase of a shaft diameter of the carriage guide shaft), or a rotation angle of the carriage guide shaft is enlarged, and there is structural limitation of the carriage guide shaft.

Further in such the paper gap adjusting device, on the occasion that the pair of carriage guide shafts move up and down over rotating in an eccentric manner, a planet gear wheel train, which configures a motive force transmission mechanism between the carriage guide shafts, does not move up and down at the same time, and therefore, by that configuration as it is, there occurs phase lag in planet motion rotation due to a planet gear between the carriage guide shafts. Consequently, on the occasion of configuring the planet gear wheel train, a design in consideration of the above-described rotation phase lag due to a planet motion has been required.

In addition, when an eccentricity amount of the carriage guide shaft is enlarged, the carriage guide shaft moves in not only up and down directions, but also back and forth directions (a paper carrying direction or a sub scanning direction), and therefore, a land-in position of an ink droplet becomes out of alignment, and it becomes impossible to perform high precision recording. In addition, a paper gap relates closely to a rotation angle of the carriage guide shaft, and therefore, in order to ensure high precision position of a paper gap, strict rotation angle control of the carriage guide shaft was required. In addition, each of the above-described two type adjusting devices of a paper gap uses a drive motor for paper feed as a drive source, and therefore, a switching mechanism for a paper gap switching operation or a paper feed operation was required separately.

SUMMARY OF THE INVENTION

The invention was proposed in view of such the related art and existence of a problem that the related art faced, and has a problem to provide a gap adjusting device which is of a simple configuration, and in which it is possible to take a gap widely, and furthermore, positional displacement in a sub scanning direction does not occur at the time of carriage lifting and lowering, and a recording apparatus which was provided with the adjusting device, and so on.

Further, the invention was made to provide a gap adjusting device in which there occurs no rotation phase lag between carriage guide shafts, even if the carriage guide shaft moves up and down, and a recording apparatus which was provided with the adjusting device, and so on.

(1) In order to solve the above-described problem, the invention provides a gap adjusting device adapted for a recording apparatus including a recording head which performs recording on a recording medium, a platen disposed in opposition to the recording head so as to define a medium gap between a head surface of the recording head and the recording medium, and a carriage on which the recording head is mounted and which reciprocates in a first direction, the gap adjusting device comprising:

a parallel lifting device including a cam mechanism, and a pair of carriage guide shafts being in a sliding contact with the carriage to thereby guide a reciprocating motion of the carriage, each of the carriage guide shafts including a concentric shaft provided with a guide shaft part which guides the carriage, and rotation shaft parts disposed on opposite ends of the guide shaft part so that the guide shaft part and the rotation shaft parts coincide with one another; and a lifting guide portion disposed in a side frame, wherein the carriage guide shaft is configured to obtain a predetermined lifting stroke in accordance with a rotation angle in cooperation with the parallel lifting device and the lifting guide portion.

According to (1) of the invention, both of the pair of carriage guide shafts adopt a concentric shaft configuration, and in addition, the lifting guide portion is disposed, and therefore, even if the carriage guide shaft rotates, positional displacement of the carriage in a sub scanning direction does not occur, and execution of high precision recording is realized. In addition, by adopting the parallel lifting device which utilized the cam mechanism, a configuration becomes simple, and compact, so that it becomes easy to design an apparatus layout, and it also becomes easy to control a rotation angle of the carriage guide shaft.

(2) In the gap adjusting device of the invention, the pair of carriage guide shafts may be provided with a main guide shaft disposed at a first side of the carriage, a sub guide shaft disposed in parallel to the main guide shaft at a second side of the carriage, and the parallel lifting device may further comprise a shift cam disposed in a vicinity of the opposite ends of the guide shaft part in each of the carriage guide shafts so as to be integrally rotatable with the guide shaft part, a cam follower fixed to the side frame, and a synchronous drive transmission mechanism which transmits a rotation of the main guide shaft to the sub guide shaft.

According (2) of the invention, when the carriage guide shaft rotates, the shift cam, which is integral with the carriage guide shaft, rotates. In addition, the cam follower, which is in a sliding contact with the shift cam, is fixed to the side frame which is disposed in a fixed state, and therefore, a lifting position or a lifting stroke of the carriage guide shaft is set up depending on a cam height of the shift cam, and adjustment of a gap is realized.

(3) In the gap adjusting device of the invention, the synchronous drive transmission mechanism may be provided with a gear wheel train, and may be configured to transmit the rotation of the main guide shaft to the sub guide shaft in an identical direction, at an identical speed, and at identical timing.

According to (3) of the invention, the synchronous drive transmission mechanism is configured by the gear wheel train, and therefore, a configuration becomes simple, and there is also no necessity to secure an operation area which is required in case that a pinion mechanism and a link mechanism were used. In addition, rotation of the main guide shaft is transmitted to the sub guide shaft in an identical direction, at an identical speed, and at identical timing, and therefore, an operation of the shift cam becomes all uniform, and the carriage becomes to move up and down in parallel.

(4) In the gap adjusting device of the invention, the lifting guide portion may be a guide groove which engages with a rotation shaft part in the carriage guide shaft and which is formed in a U-shape.

According to (4), a configuration of the lifting device becomes simple, and it becomes possible to surely prevent positional displacement of the carriage in a sub scanning direction.

(5) The invention provides a recording apparatus which is provided with a recording head which performs recording on a recording medium, a platen which is disposed in opposition to the recording head and defines a gap between a head surface of the recording head and the recording medium, and a carriage on which the recording head is mounted and which reciprocates in a first direction, wherein the gap adjusting device as described above is disposed in the recording apparatus.

According to (5) of the invention, both of the pair of carriage guide shafts adopt a concentric shaft configuration, and in addition, the lifting guide portion is disposed, and therefore, even if the carriage guide shafts rotate, there occurs no positional displacement of the carriage in a sub scanning direction, and execution of high precision recording is realized. In addition, a parallel lifting device, which utilized a cam mechanism, is adopted, and thereby, it becomes possible to provide a recording apparatus whose configuration becomes simple and compact, and by which it becomes easy to design an apparatus layout, and rotation angle control of the carriage guide shaft becomes easy.

(6) The invention provides a liquid ejection apparatus comprising:

a liquid ejection head which ejects a liquid to a medium, a platen disposed in opposition to the liquid ejection head so as to define a medium gap between a head surface of the liquid ejection head and the medium, and a carriage on which the liquid ejection head is mounted and which reciprocates in a first direction; and a gap adjusting device having a parallel lifting device including a cam mechanism, and a pair of carriage guide shafts being in a sliding contact with the carriage to thereby guide a reciprocating motion of the carriage, each of the carriage guide shafts including a concentric shaft provided with a guide shaft part which guides the carriage, and rotation shaft parts disposed on opposite ends of the guide shaft part so that the guide shaft part and the rotation shaft parts coincide with one another, and a lifting guide portion disposed in a side frame, wherein the carriage guide shaft is configured to obtain a predetermined lifting stroke in accordance with a rotation angle in cooperation with the parallel lifting device and the lifting guide portion.

(7) In another aspect of the invention, there is provided a gap adjusting device adapted for a recording apparatus including a recording head which performs recording on a recording medium, a platen disposed in opposition to the recording head so as to define a medium gap between a head surface of the recording head and the recording medium, a carriage on which the recording head is mounted and which reciprocates in a first direction, and a pair of carriage guide shafts being in a sliding contact with the carriage to thereby guide a reciprocating motion of the carriage, the gap adjusting device comprising:

a synchronous drive transmission mechanism which performs motive force transmission between the pair of carriage guide shafts, and the pair of carriage guide shafts and a synchronous drive transmission mechanism are supported by a lifting frame, and are configured to move up and down in accordance with an up and down movement of the carriage guide shaft.

According to (7) of the invention, the carriage guide shaft and the synchronous drive transmission mechanism can move up and down in an integrated manner, and therefore, there occurs no rotation phase lag between the carriage guide shafts, and motive force transmission between the carriage guide shafts is performed precisely.

(8) In the gap adjusting device of the invention, the lifting frame may be attached so as to be slidable in an up and down direction to a side frame of the recording apparatus.

According to (8) of the invention, since an existing side frame is utilized as a supporting member, it becomes possible to configure the lifting frame in a relatively compact manner without newly disposing a supporting member.

(9) In the gap adjusting device of the invention, the synchronous drive transmission mechanism may be provided with a gear wheel train, and a fitting hole which receives the carriage guide shaft and an attaching shaft of gear which configures the gear wheel train may be formed in the lifting frame.

According to (9) of the invention, it is possible to set up an operation area of the synchronous drive transmission mechanism, smaller. And it becomes possible to configure the lifting frame which is of a simple configuration and compact.

(10) The invention provides a recording apparatus which is provided with a recording head which performs recording on a recording medium, a platen which is disposed in opposition to the recording head and defines a gap between a head surface of the recording head and the recording medium, a carriage on which the recording head is mounted and which reciprocates in a first direction, and a pair of carriage guide shafts which guide a reciprocating motion of the carriage, wherein a gap adjusting device as described above is disposed in the recording apparatus.

According to (10) of the invention, the carriage guide shaft and the synchronous drive transmission mechanism can move up and down in an integrated manner, and therefore, there occurs no rotation phase lag between the carriage guide shafts, and it becomes possible to provide a recording apparatus which is provided with a gap adjusting device which can surely performs motive force transmission between carriage guide shafts.

(11) The invention provides a liquid ejection apparatus comprising:

a liquid ejection head which ejects a liquid to a medium;

a platen disposed in opposition to the liquid ejection head so as to define a medium gap between a head surface of the liquid ejection head and the medium;

a carriage on which the liquid ejection head is mounted and which reciprocates in a first direction;

a pair of carriage guide shafts being in a sliding contact with the carriage to thereby guide a reciprocating motion of the carriage; and a gap adjusting device including a synchronous drive transmission mechanism which performs motive force transmission between the pair of carriage guide shafts, and wherein the pair of carriage guide shafts and a synchronous drive transmission mechanism are supported by a lifting frame, and are configured to move up and down in accordance with an up and down movement of the carriage guide shaft.

DETAILED DESCRIPTION OF THE PREFERRED EMBODIMENTS

Figure 1:
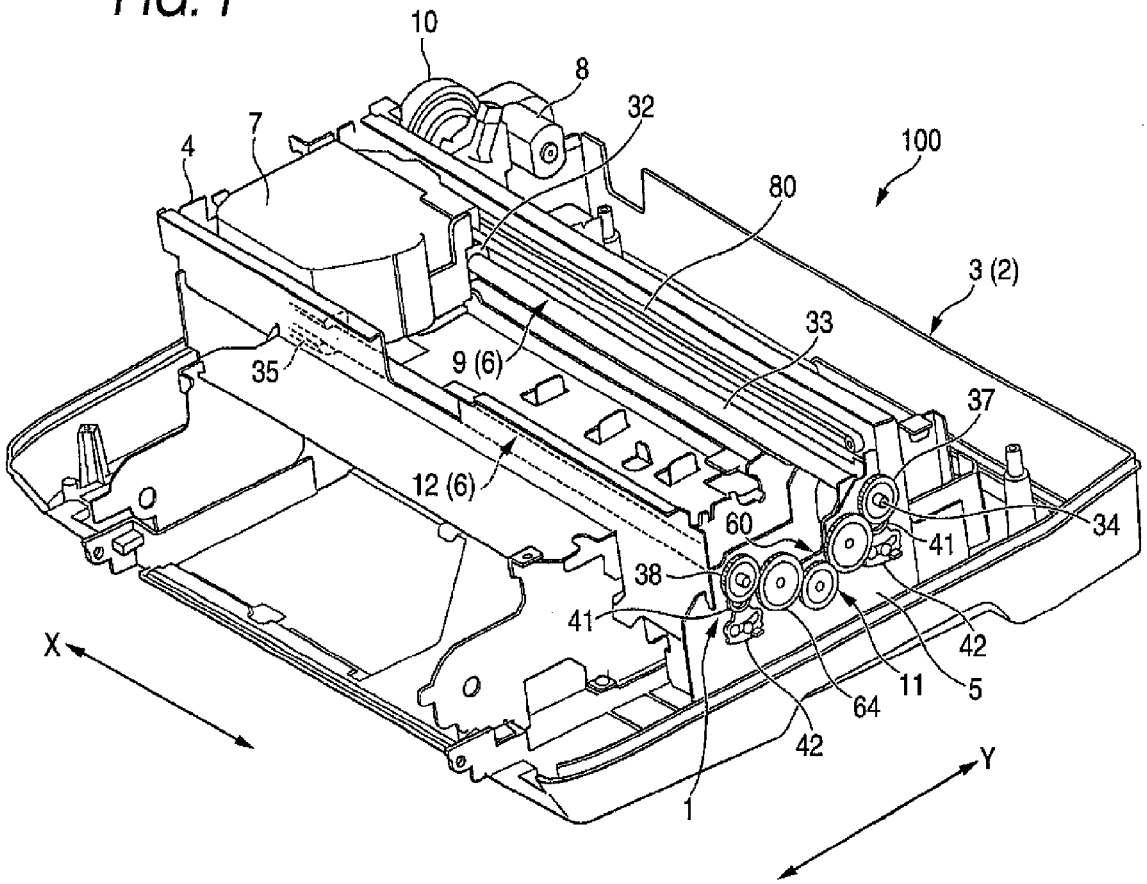
FIG. 1 is a perspective view of an ink jet printer from a synchronous drive transmission side.

Hereinafter, a recording apparatus, which is one example of a gap adjusting device and a liquid ejection apparatus which was provided with the adjusting device relating to the invention, will be described. At the beginning, an ink jet printer is picked up as a best mode for carrying out the recording apparatus, and an outline of its overall configuration will be described on the basis of drawings. FIG. 1 is a perspective view from a synchronous drive transmission mechanism side, showing an outline of an internal configuration of the ink jet printer, and FIG. 2 is a perspective view from a lifting drive motor side, showing an outline of an internal configuration of the ink jet printer.

Figure 2:
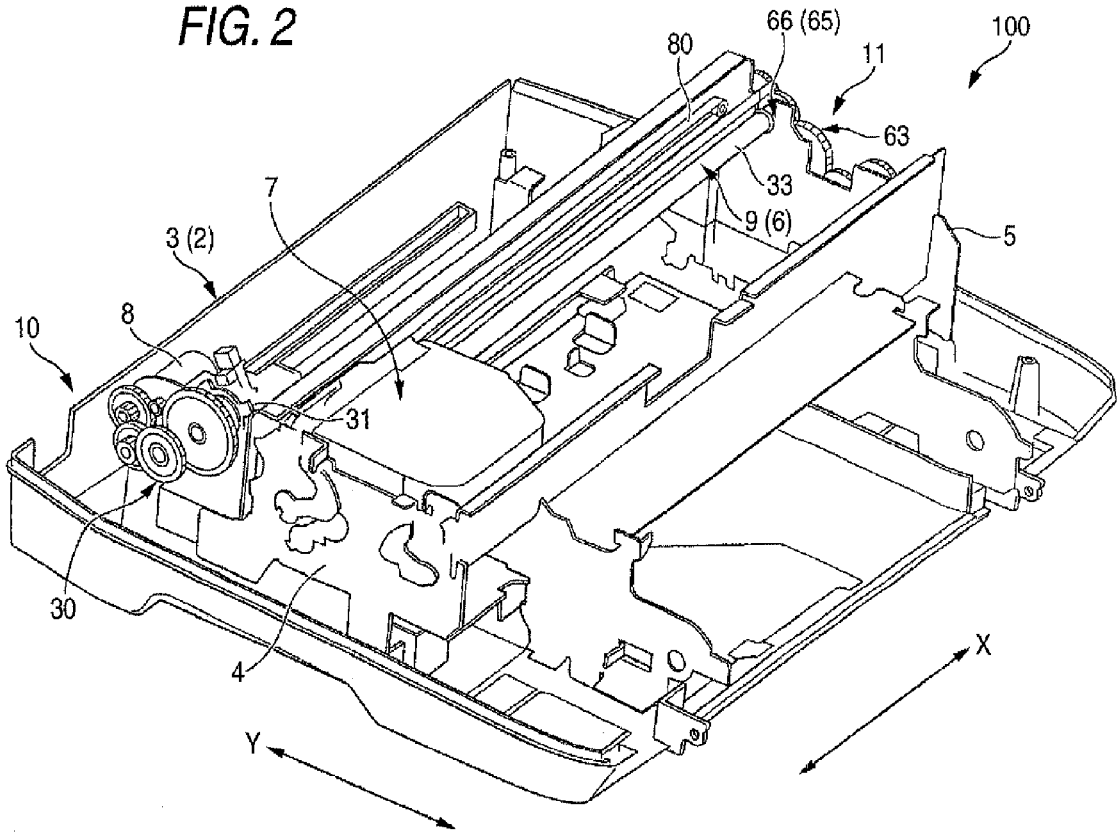
FIG. 2 is a perspective view of the ink jet printer from a lifting drive motor side.

FIGS. 1 and 2 show only relevant members of a gap adjusting device 1 of the invention and in the vicinity of an installation region of the adjusting device 1, and show an ink jet printer 100 which is in such a state that other members with no relation to the invention were removed. On a bottom portion of the ink jet printer 100, disposed is a base frame 3, which is a part of a printer main body 2 as one example of a liquid ejection apparatus main body. In addition, in the vicinity of left and right (main scanning direction X) end portions on the base frame 3, disposed are side frames 4, 5 in a fixed state. Meanwhile, in FIGS. 1 and 2, in case of distinguishing a side frame which is located on the left side and a side frame which is located on the right side, both things are distinguished by applying a reference numeral "4" to the former and applying a reference numeral "5" to the latter. Pair of carriage guide shafts 6 are bridged in parallel between the side frame on the left side and the side frame 5 on the right side. The carriage guide shafts 6 are disposed on a front surface side and a rear surface side of a carriage 7 so as to sandwich the carriage 7 one by one. In addition, on the side frame 4 on the left side, disposed are a lifting drive motor 8, which is disposed separately from a carrying drive motor and becomes a drive source for exclusive use in a gap adjusting device of the invention, and start end side drive transmission means 10 which transmits rotation of the lifting drive motor 8 to the carriage guide shaft 6 which is located on a rear portion side of the carriage 7 (hereinafter, referred to as a main guide shaft 9).

On one hand, on the side frame 5 on the right side, disposed is a synchronous drive transmission mechanism 11, which is a part of a gap adjusting device of the invention. Meanwhile, the synchronous drive transmission mechanism 11 undertakes a role of transmitting rotation of the main guide shaft 9 to the carriage guide shaft 6 which is disposed on a front surface side of the carriage, 7 (hereinafter, referred to as a sub guide shaft 12) in a synchronized state.

Figure 3:
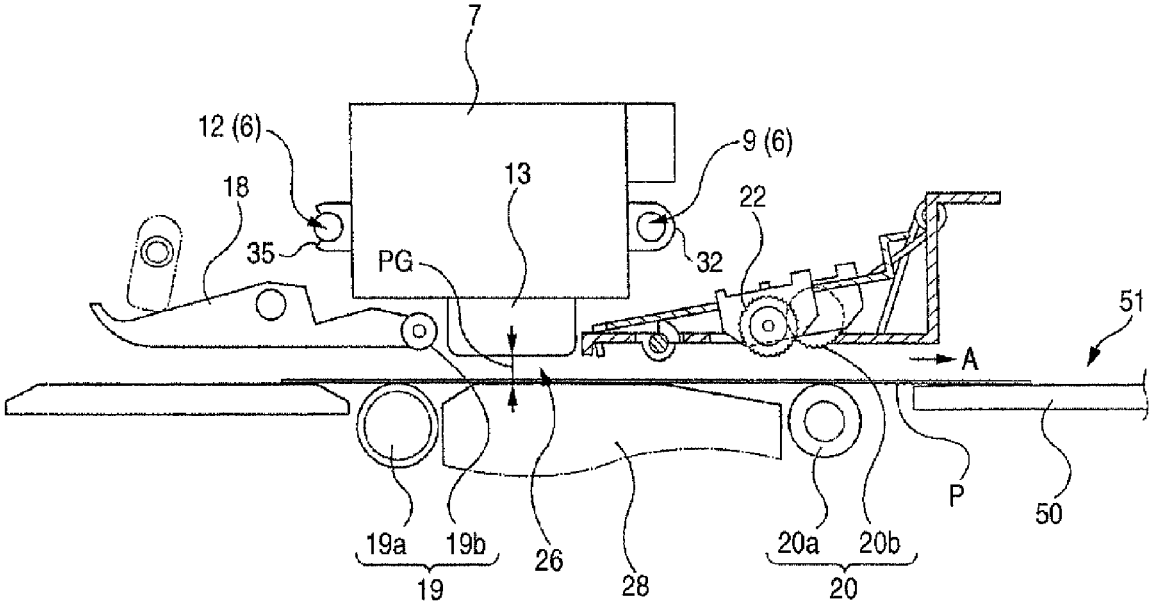
FIG. 3 is a sectional side view showing an outline of an internal configuration of the ink jet printer.

Next, on the basis of FIG. 3, a configuration of the ink jet printer 100, which does not appear in FIGS. 1 and 2, will be described. FIG. 3 shows various members which configure a carrying path of a medium P to be recorded (hereinafter, simply referred to as a paper P) which is one example of a medium to which liquid is ejected, a recording head 13 as recording execution means which is one example of liquid emission executing means, and the carriage 7 which is a holding member of the recording head 13.

The paper P, which was set on a feeding tray or a feeding cassette which are not shown in the figure, is pulled out by a pickup roller which is not shown in the figure, and only uppermost one paper P is selected and fed toward a carrying roller 19, by a feeding roller which is not shown in the figure and a retard roller which is one example of separation means.

The paper P, which was fed, is sandwiched between carrying rollers 19 which are configured by a carrying drive roller 19*a* and a carrying driven roller 19*b*, and is carried by drive rotation of the carrying drive roller 19*a* in a sub scanning direction Y which is orthogonal with a main scanning direction X, by a predetermined carrying amount. Among them, as to the carrying driven roller 19*a*, a plurality of the rollers 19*a* are disposed, and supported driven-rotatably by roller holders 18 individually. In addition, the roller holder 18 is always receiving a bias force from biasing means which is not shown in the figure, and by this means, the carrying driven rollers 19*b* are maintained in such a nip state that they are always contacted to the carrying drive roller 19*a* with pressure.

The paper P, which is carried in such a state that it was sandwiched by the carrying rollers 19 with pressure, is pressured from above by an auxiliary pressing roller and a pressing plate which are located in the vicinity of the carrying driven roller 19*b* and on a downstream side of a paper carrying direction A and not shown in the figure, and thereby, its lift is prevented, and in such a state, it is guided to a recording position 26 which is on the lower side of the recording head 13. As to the paper P, which was guided to the recording position 26, passing timing etc. of the paper P are detected by a detection device which is not shown in the figure, and recording is started, and desired recording is performed across almost an entire surface of a recording surface of the paper P by operations of the carriage 7 and the paper P.

Then, on the carriage 7, mounted is the recording head 13, which is one example of a liquid ejection head which discharges (ejects) ink, which is one example of liquid, on the paper P etc. to perform recording. In addition, in an upper part space in the printer main body 2, disposed is an ink cartridge which is one example of a liquid cartridge and is not shown in the figure, and ink in the ink cartridge is guided through an ink tube which is not shown in the figure to an inside of the carriage 7, by ink supplying means which is not shown in the figure. In addition, to the carriage 7, a timing belt 80, which is wound between pulleys disposed at both end portions of the main scanning direction X, is connected, and, receiving a driving force from a belt drive motor which is not shown in the figure, the carriage 7 can move back and forth in the main scanning direction X.

On the lower side of the recording head 13, disposed is a platen 28 which defines a paper gap PG between a head surface of the recording head 13 and the paper P etc. in opposition to the recording head 13. Meanwhile, the paper gap PG becomes an extremely important factor in performing high precision recording, and is configured so as to be properly adjusted by the adjusting device of the invention, in accordance with change of a thickness of the paper P. Then, by repeating an operation of carrying the paper P etc. between the carriage 7 and the platen 28 in the sub scanning direction Y by a predetermined carrying amount, and an operation of ejecting ink to the paper P etc. from the recording head 13 during such a period that the recording head 13 goes and returns one time in the main scanning direction X, one after the other, recording on the paper P etc. is performed.

On the downstream side of the recording head 13 in the paper carrying direction A, disposed is a discharging roller 20 which is configured by a discharging drive roller 20*a* and a discharging serrated roller 20*b* and is one example of means for discharging a medium to which liquid is ejected, and the paper P, which was discharged by this discharging roller 20, is to be discharged to a mounting surface 51 on a discharging stacker 50 which is located on the much further downstream side and is one example of a portion for receiving a medium to which liquid is ejected.

The discharging serrated roller 20*b* is a toothed roller having a plurality of teeth at its outer circumference, and is supported so as to be freely rotatable by a roller holder for the discharging serrated roller. In the vicinity of the discharging serrated roller 20*b*, disposed is an auxiliary serrated roller 22, and the paper P is to be pressed on the slightly lower side by the auxiliary serrated roller 22. In addition, as to the carrying driven roller 19*b*, its shaft center position is disposed on the slightly downstream side than the carrying driven roller 19*a*, and further, as to the discharging serrated roller 20*b*, its shaft center position is disposed on the slightly upstream side than the discharging drive roller 20*a*.

By such the configuration, the paper P becomes a curved state commonly called as "reverse warping" in which it is slightly protruded downward between the carrying roller 19 and the discharging roller 20, and the paper P, which is located at a position facing to the recording head 13, is pressed to the platen 28, and by this means, lift of the paper P is prevented, and recording is performed normally. Meanwhile, the auxiliary serrated roller 20 is configured by a toothed roller in the same manner as the discharging serrated roller 20*b*, and supported by a roller holder for auxiliary serrated roller.

EMBODIMENT

Figure 4:
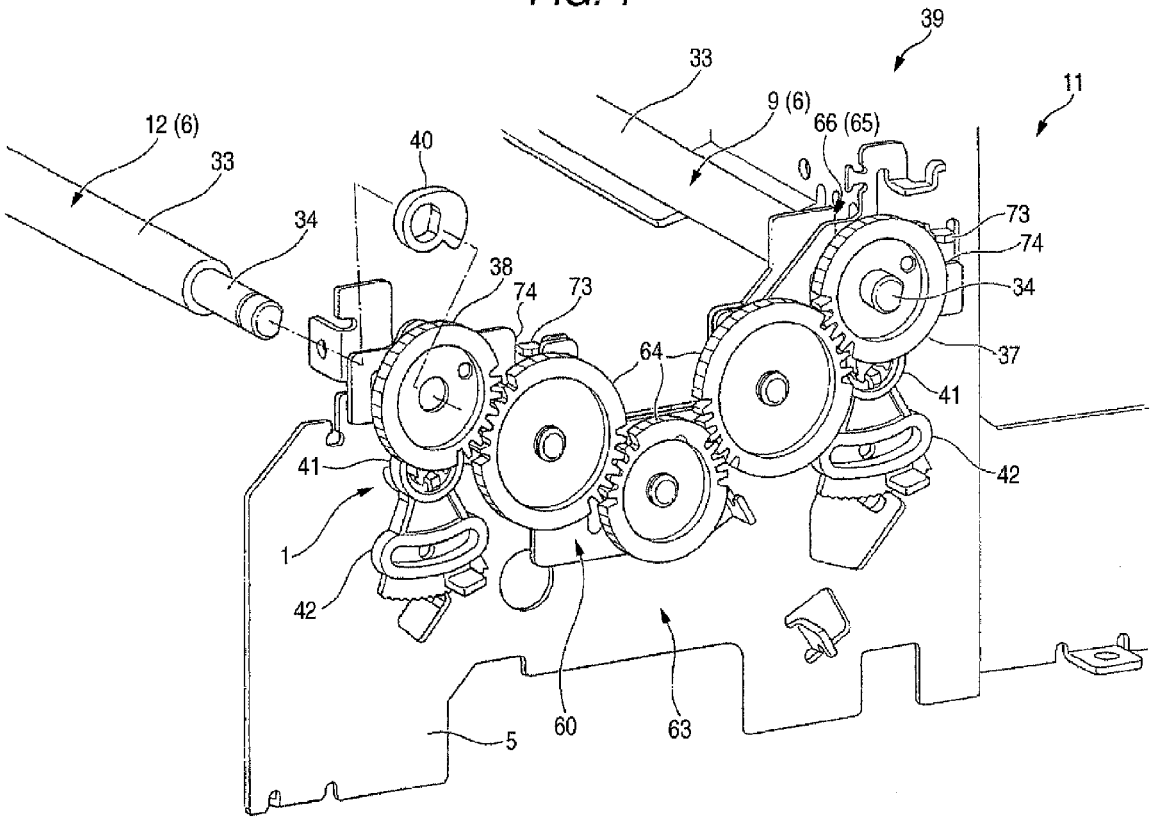
FIG. 4 is a perspective view showing an installed state of the synchronous drive transmission mechanism.
Figure 5:
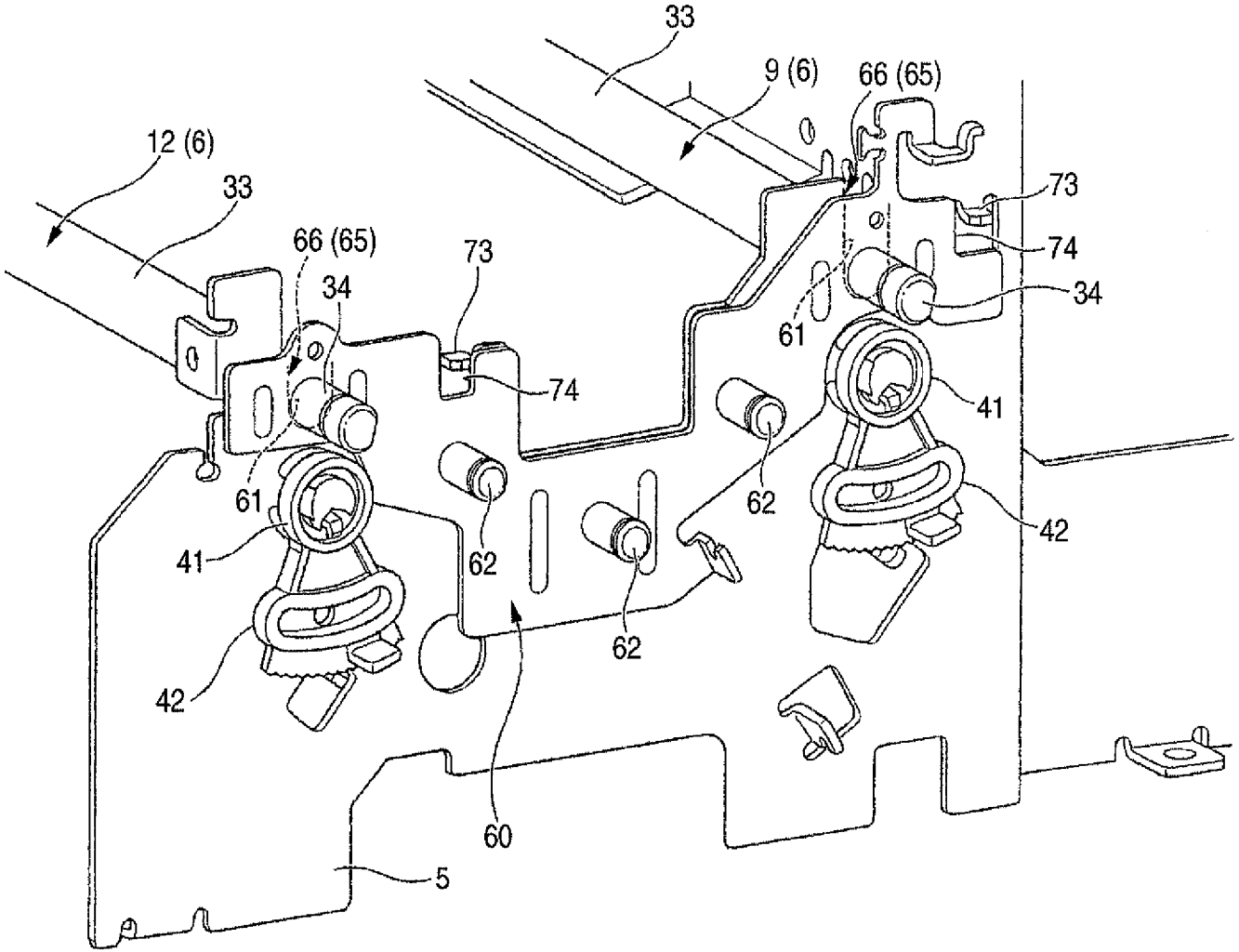
FIG. 5 is a perspective view showing an installed state of a lifting frame.
Figure 6:
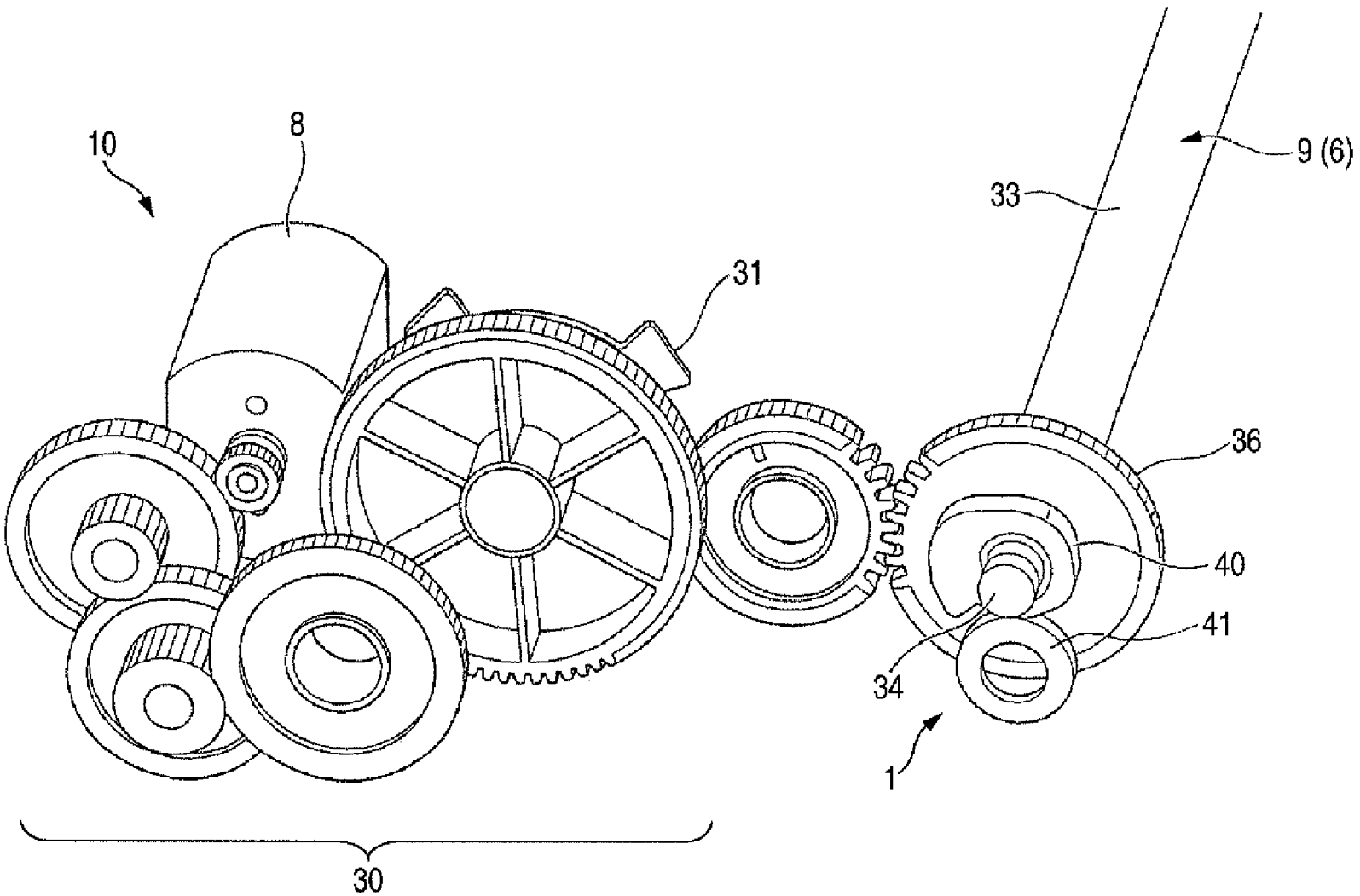
FIG. 6 is a perspective view showing start end side drive transmission means.
Figure 7:
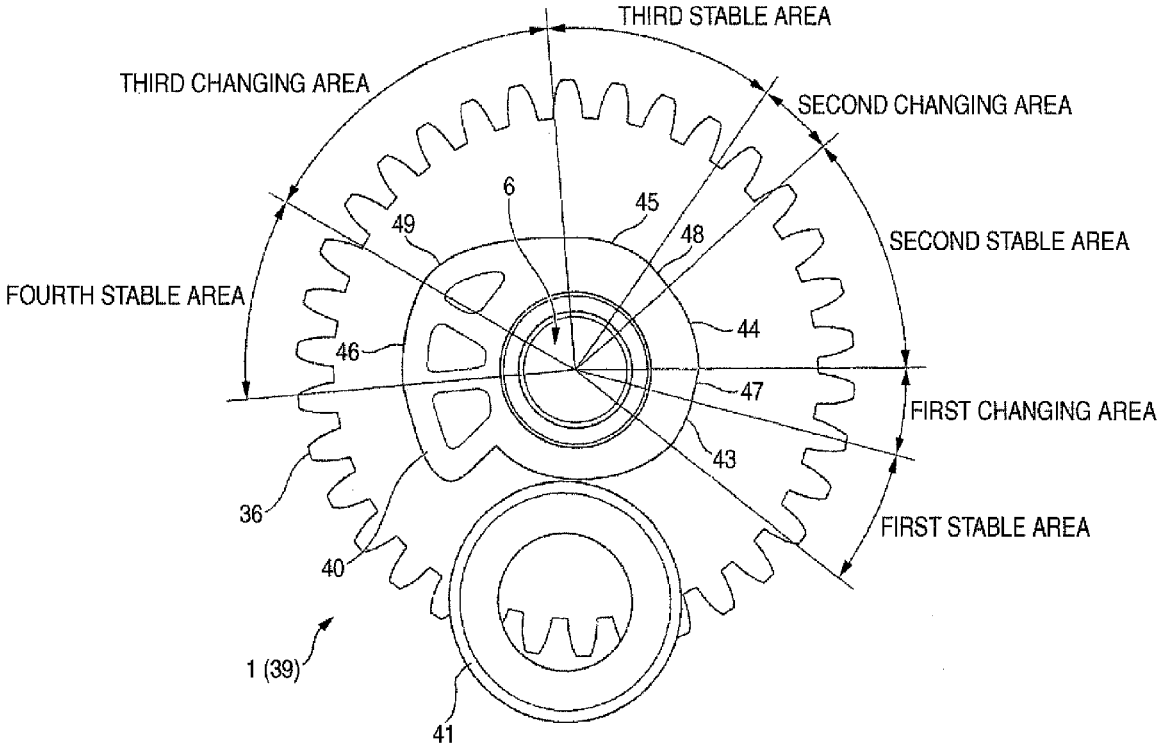
FIG. 7 is an explanatory view showing cam operations of a shift cam and a cam follower.
Figure 8:
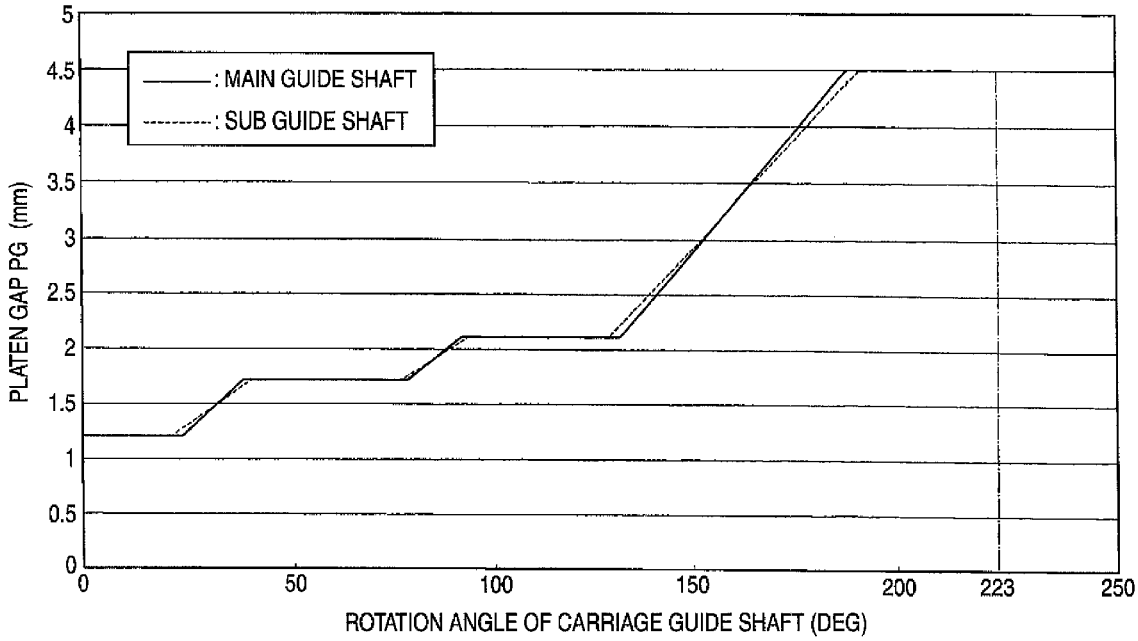
FIG. 8 is a cam diagram showing a relation of a paper gap and a rotation angle of a carriage guide shaft.

Next, a configuration of the gap adjusting device 1 which is applied to such the ink jet printer 100 and relates to the invention will be described in more detail. FIG. 4 is a perspective view showing the side frame on the right side in such a state that a synchronous drive transmission mechanism was attached thereto, and FIG. 5 is a perspective view showing the side frame on the right side in such a state that a synchronous drive transmission mechanism was attached thereto. FIG. 6 is a perspective view showing start end side drive transmission means, and FIG. 7 is an explanatory view showing cam operations of a shift cam and a cam follower. In addition, FIG. 8 is a cam diagram showing a relation of a paper gap and a rotation angle of a carriage guide shaft.

Rotation of an output shaft of the lifting drive motor 8 is transmitted to the main guide shaft 9 by start end side drive transmission means 10 which is configured by a gear wheel train 30 as shown in FIG. 6. In midstream of the gear wheel train 30, disposed is a composite gear having a detection wing called as a flag 31, and the flag 31 is detected by rotation angle detection means such as a rotary encoder etc. which are not shown in the figure, and thereby, a rotation angle of the main guide shaft 9 is controlled. Meanwhile, although graphic display is omitted, a rotation angle of the sub guide shaft 12 is also detected and controlled by a rotary encoder etc. which are not shown in the figure.

The main guide shaft 9 is in sliding contact with a bearing portion 32 on a rear surface side of the carriage 7, and has such a concentric shaft configuration that a guide shaft part 33, which directly guides a reciprocating motion of the carriage 7, and rotation shaft parts 34, which are disposed at both ends thereof, were disposed so as to coincide therewith. In addition, the sub guide shaft 12 is also configured by the guide shaft part 33 and the rotation shaft part 34, in the same manner as the main guide shaft 9, and has such a concentric shaft configuration that the guide shaft part 33 and the rotation shaft part 34 were disposed so as to coincide therewith. Meanwhile, the guide shaft part 33 of the sub guide shaft 12 fits in and is in sliding contact with a bearing portion 35 on a front surface side of the carriage 7.

On both end portions of the guide shaft part 33 in the main guide shaft 9, a transmission gear 36 is disposed on an input side and a transmission gear 37 is disposed on an output side, respectively, integrally with the guide shaft part 33. The transmission gear 36 is a gear which is located at a dead end of the start end side drive transmission means 10, and the transmission gear 37 is a gear which is located at a start end of the synchronous drive transmission mechanism 11. In addition, a transmission gear 38 is disposed also on an input side of the guide shaft part 33 in the sub guide shaft 12, and this transmission gear 38 is a gear which is located at a dead end of the synchronous drive transmission mechanism 11.

In addition, on both end portions of the guide shaft part 33 in the main guide shaft 9 and the sub guide shaft 12, a shift cam, which is a part of a parallel lifting device 39 as one of characteristic configurations in the gap adjusting device 1 of the invention, is disposed integrally with the guide shaft part 33. In addition, on the lower side of the shift cam 40, disposed is a cam follower 41 which is a part of the parallel lifting device 39 likewise.

Meanwhile, the cam follower 41 is fixed to the side frames 4, 5 through an adjuster 42. The adjuster 42 turns integrally with the ring-shaped cam follower 41, and has a role of finely adjusting a height of the cam follower 41 by varying an attachment angle to the side frames 4, 5.

The shift cam 40 has four stable areas in which a cam height does not change, as shown in FIGS. 7 and 8. These stable areas are referred to as a first stable area 43, a second stable area 44, a third stable area 45, and a fourth stable area 46 in the order corresponding to a lower cam height. In addition, between respective stable areas, disposed is a changing area, and a changing area, which is disposed between the first stable area 43 and the second stable area 44, is referred to as a first changing area 47, and a changing area, which is disposed between the second stable area 44 and the third stable area 45, is referred to as a second changing area 48, and a changing area, which is disposed between the third stable area 45 and the fourth stable area 46, is referred to as a third changing area 49.

FIG. 8 shows a relation of the paper gap PG and a rotation angle of each shaft, dividing into the main guide shaft 9 and the sub guide shaft 12. Meanwhile, as apparent from the figure, the main guide shaft 9 and the sub guide shaft 12 have extremely similar characteristics, and it shows such a sign that two shafts rotate synchronously. Explaining the main guide shaft 9 among them as an example, in the first stable area 43, the paper gap PG is approximately 1.2 mm, and a rotation angle is constant within a scope of approximately 23°. In addition, in the second stable area 44, the paper gap PG is approximately 1.7 mm, and a rotation angle is constant within a scope of approximately 40°. In addition, in the third stable area 45, the paper gap PG is approximately 2.1 mm, and a rotation angle is constant within a scope of approximately 40°. In addition, in the fourth stable area 46, the paper gap PG is approximately 4.5 mm, and a rotation angle is constant within a scope of approximately 35°.

Therefore, a width is disposed in a large way for a rotation angle of the carriage guide shaft 6 in order to obtain a predetermined paper gap PG, and strict rotation angle control of the carriage guide shaft 6 becomes unnecessary. In addition, in the invention, rotation of the carriage guide shaft 6 is carried out by the independent lifting drive motor 8 which is separated from the carrying drive motor, and therefore, a mechanism or an operation for switching adjusting time of the paper gap PG and carrying time of the paper P is unnecessary.

On the side frame 5 on the right side, disposed is a lifting frame 60 which can be lifted and lowered together with the carriage guide shaft 6 as shown in FIG. 5 and is one of characteristic configurations of the invention. In the lifting frame 60, a plurality of fitting holes 61, which can receive the rotation shaft parts 34 in the carriage guide shafts 6, are disposed, and a plurality of attaching shafts 62 for attaching gears are raised outward. Then, the rotation shaft parts 34, which are protruded from the fitting holes 61, are disposed, and the gear wheel train 63, as the synchronous drive transmission mechanism 11 which is one of characteristic configurations of the invention, is disposed by utilizing the attaching shaft 62, as shown in FIG. 4.

The gear wheel train 63 is configured by disposing three pieces of middle gears 64 between the transmission gear 37 and the transmission gear 38, and is configured so as to be able to transmit rotation of the main guide shaft 9 to the sub guide shaft 12 in an identical direction, at an identical speed, and at identical timing. In addition, on the side frames 5 and 6, disposed is a lifting guide portion 65 which is one of constituent members of the gap adjusting device 1 of the invention. In this embodiment, U-shaped four guide grooves 66, which engage with the rotation shaft part 34 in the carriage guide shaft 6, are formed to the side frames 4 and 5, and thereby, the lifting guide portion 65 is configured.

In addition, on the side frame 4 and 5, disposed are retaining pieces 73 which were bent into a hook on the lifting frame 60 side. On one hand, on the lifting frame 60, disposed are hollow-shaped or hook-shaped engaging grooves 74 which engage with these retaining pieces 73. When the lifting frame 60 moves to the upper side, a lower end side of the engaging groove 74 contacts to the retaining piece 73, and thereby, dropout of the lifting frame 60 from the side frames 4 and 5 is prevented.

Next, paper gap PG adjustment procedures, which are carried out by utilizing the gap adjusting device 1 of such the configuration, will be described. Firstly, in case of using the paper P with a most common thickness, a rotation angle of the carriage guide shaft 6 is set up to an arbitrary angle within a scope of approximately 0°~23°, and is made to lead into the first stable area 43. Adversely, in case of using the medium P to be recorded with a wall thickness of a CD-R tray etc., a rotation angle of the carriage guide shaft 6 is set up to an arbitrary angle within a scope of approximately 188°~223°, and is made to lead into the fourth stable area 46.

The lifting drive motor 8 rotates by a predetermined amount, in accordance with a setup amount of the above-described rotation angle of the carriage guide shaft 6, and transmits rotation to the main guide shaft 9 through the gear wheel train 30. When the main guide shaft 9 rotates only by a predetermined rotation angle which was set up, the shift cam 40, which is disposed integrally with the main guide shaft 9, also rotates only by an identical rotation angle, and moves the main guide shaft 9 to the upper side or the lower side, by that much of a cam height at the rotation angle.

Since rotation of the main guide shaft 9 is also transmitted to the sub guide shaft 12 through the-gear wheel train 63, all of the four shift cams 40 rotates in an identical direction, at an identical rotation angle, and at identical timing, and an identical cam height is realized. By this means, the carriage 7 moves up and down over maintaining a horizontal attitude, to change a height of the recording head 13, and thereby, adjustment of the paper gap PG is carried out.

OTHER EMBODIMENTS

Figure 9:
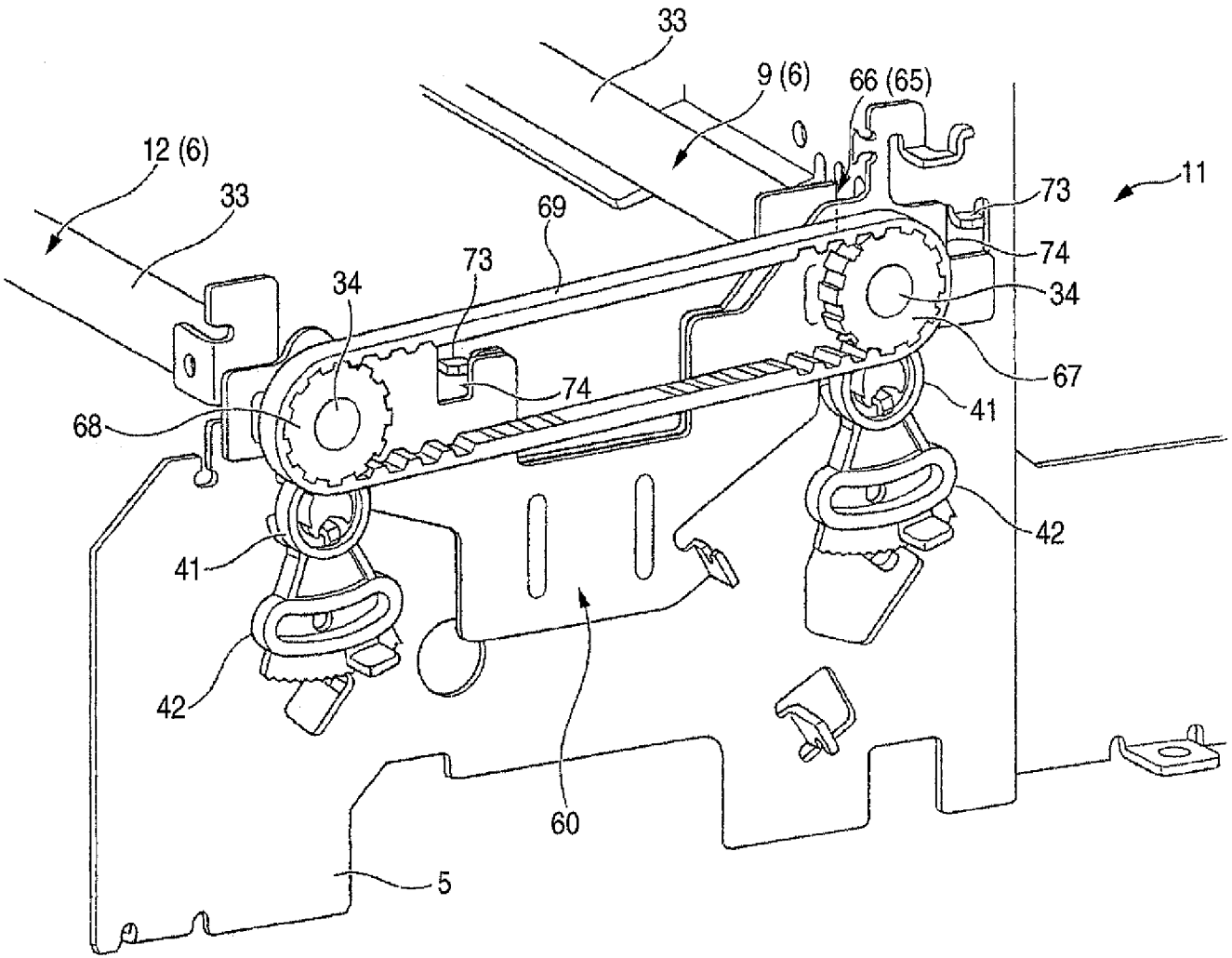
FIG. 9 is a perspective view showing another embodiment of the synchronous drive transmission mechanism.
Figure 10:
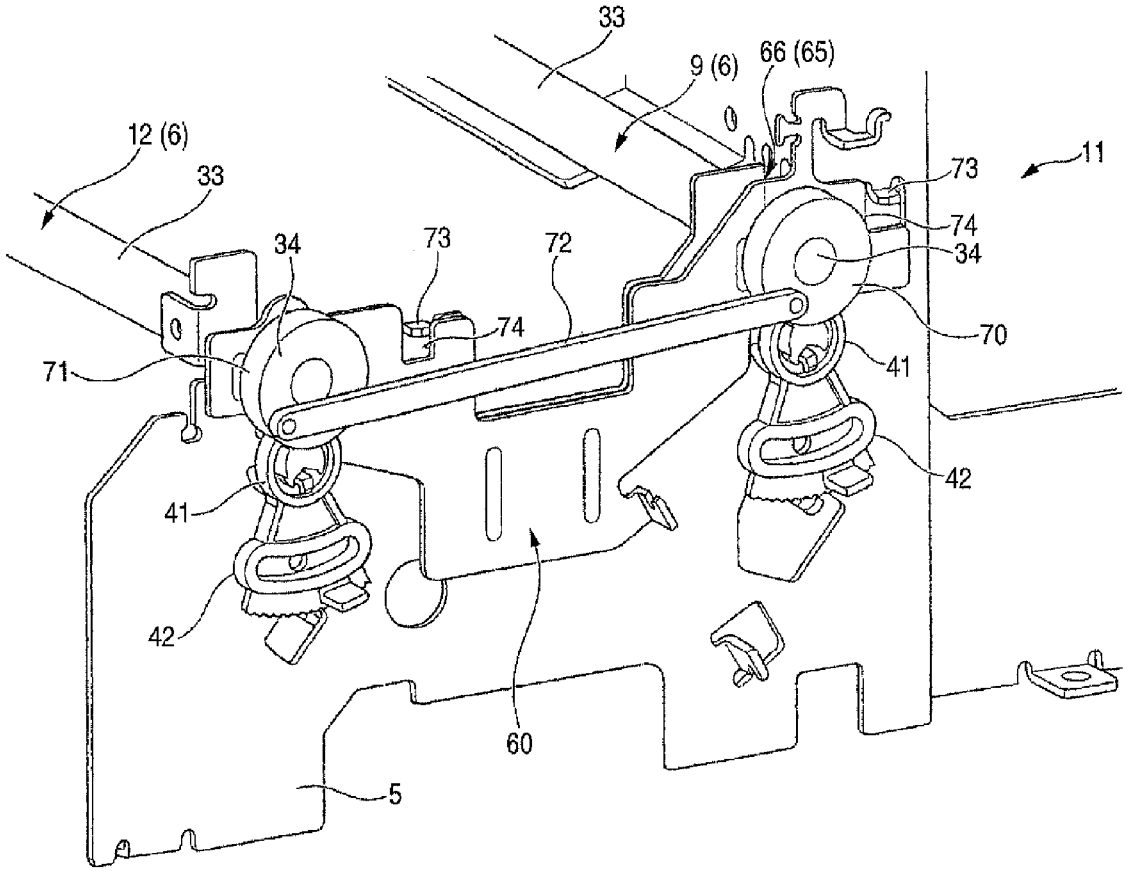
FIG. 10 is a perspective view showing yet another embodiment of the synchronous drive transmission mechanism.

A gap adjusting device and a recording apparatus which was provided with the adjusting device, etc. which relate to the invention, are based on the configuration which was described above, but it is, of course, possible to carry out a change and an omission etc. of a partial configuration within a scope which is not departing the spirit of the invention. For example, as another configuration of the synchronous drive transmission mechanism 11, as shown in FIG. 9, it may be such a configuration that timing pulleys 67 and 68, which were disposed on the main guide shaft 9 and the sub guide shaft 12, respectively, and a timing belt 69, which is wound between these, were disposed. In addition, as shown in FIG. 10, it may also be such a configuration that rotation circular plates 70 and 71, which were disposed on the main guide shaft 9 and the sub guide shaft 12, respectively, and a coupling rod 72, which couples these rotatably, were disposed.

In addition, since the paper gap PG grows larger in proportion to a cam height of the shift cam 40, it is possible to obtain a much larger paper gap PG by enlarging only the shift cam 40, without relation to a shaft diameter of the carriage guide shaft 6. In addition to this, in the ink jet printer 100 in which the carriage 7 is disposed in an inclined posture, in order for the shift cam 40 not to be separated from the cam follower 41, it is also possible to dispose biasing means etc. for constantly holding both things in a contact state. In addition, it is also possible to share the lifting drive motor and the carrying drive motor.

What is claimed is:

1. A gap adjusting device adapted for a recording apparatus including:

a recording head which performs recording on a recording medium, a platen disposed in opposition to the recording head so as to define a medium gap between a head surface of the recording head and the recording medium, and a carriage on which the recording head is mounted and which reciprocates in a first direction, the gap adjusting device comprising:

a parallel lifting device including a cam mechanism, and a pair of carriage guide shafts being in a sliding contact with the carriage to thereby guide a reciprocating motion of the carriage, each of the carriage guide shafts including a guide shaft part which guides the carriage, and rotation shaft parts disposed on opposite ends of the guide shaft part so that the guide shaft part and the rotation shaft parts are concentric with each other; and a lifting guide portion disposed in a side frame, wherein the carriage guide shafts are configured to obtain a predetermined lifting stroke in accordance with a rotation angle in cooperation with the parallel lifting device and the lifting guide portion, wherein the pair of carriage guide shafts are provided with a main guide shaft disposed at a first side of the carriage, a sub guide shaft disposed in parallel to the main guide shaft at a second side of the carriage, and the parallel lifting device further comprises a shift cam disposed in a vicinity of the opposite ends of the guide shaft part in each of the carriage guide shafts so as to be integrally rotatable with the guide shaft part, a cam follower fixed to the side frame, and a synchronous drive transmission mechanism which transmits a rotation of the main guide shaft to the sub guide shaft.

2. A gap adjusting device according to claim 1, wherein the synchronous drive transmission mechanism is provided with a gear wheel train, and is configured to transmit the rotation of the main guide shaft to the sub guide shaft in an identical direction, at an identical speed, and at identical timing.

3. A gap adjusting device adapted for a recording apparatus including a recording head which performs recording on a recording medium, a platen disposed in opposition to the recording head so as to define a medium gap between a head surface of the recording head and the recording medium, a carriage on which the recording head is mounted and which reciprocates in a first direction, and a pair of carriage guide shafts being in a sliding contact with the carriage to thereby guide a reciprocating motion of the carriage, the gap adjusting device comprising:

a synchronous drive transmission mechanism which performs motive force transmission between the pair of carriage guide shafts, and the pair of carriage guide shafts and the synchronous drive transmission mechanism are supported by a lifting frame, and are configured to move up and down in accordance with an up and down movement of the lifting frame.

4. The gap adjusting device according to claim 3, wherein the lifting frame is attached so as to be slidable in an up and down direction to a side frame of the recording apparatus.

5. The gap adjusting device according to claim 3, wherein the synchronous drive transmission mechanism is provided with a gear wheel train, and a fitting hole which receives the carriage guide shaft and an attaching shaft of gear which configures the gear wheel train are formed in the lifting frame.

6. A recording apparatus which is provided with a recording head which performs recording on a recording medium, a platen which is disposed in opposition to the recording head and defines a gap between a head surface of the recording head and the recording medium, a carriage on which the recording head is mounted and which reciprocates in a first direction, and a pair of carriage guide shafts which guide a reciprocating motion of the carriage, wherein a gap adjusting device according to claim 3 is disposed in the recording apparatus.

7. A liquid ejection apparatus comprising:

a liquid ejection head which ejects a liquid to a medium;

a platen disposed in opposition to the liquid ejection head so as to define a medium gap between a head surface of the liquid ejection head and the medium;

a carriage on which the liquid ejection head is mounted and which reciprocates in a first direction;

a pair of carriage guide shafts being in a sliding contact with the carriage to thereby guide a reciprocating motion of the carriage; and a gap adjusting device including a synchronous drive transmission mechanism which performs motive force transmission between the pair of carriage guide shafts, and wherein the pair of carriage guide shafts and the synchronous drive transmission mechanism are supported by a lifting frame, and are configured to move up and down in accordance with an up and down movement of the lifting frame.

* * * * *